US006704934B2

(12) United States Patent
Graham et al.

(10) Patent No.: US 6,704,934 B2
(45) Date of Patent: Mar. 16, 2004

(54) BALLISTIC VEST

(76) Inventors: Ted Graham, 3500 Darwin Ave., Cincinnati, OH (US) 45211; Michael W. Sankey, 4630 Terraceview La., Plymouth, MN (US) 55446

( * ) Notice: Subject to any disclaimer, the term of this patent is extended or adjusted under 35 U.S.C. 154(b) by 0 days.

(21) Appl. No.: 09/732,308

(22) Filed: Dec. 7, 2000

(65) Prior Publication Data

US 2002/0069444 A1 Jun. 13, 2002

(51) Int. Cl.[7] ..... F41H 1/02
(52) U.S. Cl. ..... 2/2.5; 89/36.02; 428/911
(58) Field of Search ..... 2/2.5, 92, 102; 89/36.01, 36.02, 36.05; 428/911

(56) References Cited

U.S. PATENT DOCUMENTS 3,562,810 A * 2/1971 Davis ..... 2/2.5
3,783,449 A * 1/1974 Davis ..... 2/2.5
4,079,464 A * 3/1978 Roggin ..... 2/2.5
4,413,357 A * 11/1983 Sacks ..... 2/2.5
4,602,384 A * 7/1986 Schneider ..... 441/103
5,331,683 A * 7/1994 Stone et al. ..... 2/2.5
5,471,906 A * 12/1995 Bachner et al. ..... 89/36.05
5,534,343 A * 7/1996 Landi et al. ..... 428/313.5
5,918,309 A * 7/1999 Bachner ..... 2/2.5
5,960,470 A * 10/1999 Bachner ..... 2/2.5

* cited by examiner

*Primary Examiner*—Tejash Patel
(74) *Attorney, Agent, or Firm*—Wood, Herron & Evans LLP

(57) ABSTRACT

Improved body armor includes a ballistic panel having an internal ballistic component protected from moisture by an integral, sonic welded moisture impervious cover. No moisture can intrude into the ballistic component. Mildew and moisture induced performance degradation is prevented. Cost of ownership is reduced over multiple armor refurbishment cycles.

10 Claims, 2 Drawing Sheets

BALLISTIC VEST

FIELD OF THE INVENTION

This invention relates to body armor such as ballistic vests and more particularly to improvements in body armor performance, longevity and maintenance.

BACKGROUND OF THE INVENTION

Body armor or ballistic vests typically include a vest-like garment containing pockets to hold ballistic panels in place over critical areas of the body, i.e. chest, back and rib cage. In some instances, the panel pockets have openings for ballistic panel insertion or removal.

The ballistic panels take many forms. One form of well-known panel is made from a plurality of layers of various material covered by a moisture-resistant material sewn at its edge seams. These panels are constructed to resist penetration by projectiles of known weights traveling at or below known velocities. While such panels have worked well for so long as their integrity is retained, they embody several inherent problems which are capable of reducing their performance, and require expensive replacement.

One of these problems relates to moisture intrusion, leading both to performance degradation and maintenance expense. Where moisture intrudes into the panel structure, it causes unpleasant odor, unsanitary mildew and staining. The source of such moisture may typically be human perspiration of the wearer. Other sources such as ambient humidity, rain, immersion, uses of cleaning materials, etc. may also lead to such moisture intrusion and mildew. Such intrusion usually occurs at the sewn panel seams. Moisture can intrude through the sew or thread holes. Rough usage can elongate the holes increasing the potential for moisture intrusion. Rough usage may also cause seam pull-apart, allowing further moisture into the panel structure.

More importantly, wetting or moisturizing of the panel structure can significantly degrade its ballistic performance. Such armor is typically classified by the National Institute of Justice (NIJ) in "threat levels", such as Threat Level IIA, II, III etc. with the higher number providing protection against a higher ballistic force or threat. While a new panel may test to one threat level, it may not provide sufficient protection to that threat level when wet or moisturized. Thus, a wearer may feel protected against a particular threat level when wearing a vest containing the panel, but moisture in the panel may have actually reduced the level of protection below the level expected.

These effects of moisture intrusion require professional correction by the manufacturer. Typically the vests are returned for refurbishment. Typically, the vest material and panel covers are removed and replaced, and the ballistic panels are inspected. Damaged ballistic materials are replaced. The covers are re-sewn, the panels inserted in the fresh vest and the vest is returned to the user. Since the ballistic panels are the most expensive component of the vests, such a vest reconditioning process is expensive and can cost up to a significant portion of the initial cost of the vest.

Accordingly, it has been one objective of the invention to provide an improved panel, with improved moisture resistance, and method of making same.

Another objective of the invention has been to provide an improved ballistic panel offering more consistent threat level performance throughout its useful and extended service life.

Another objective of the invention has been to provide a ballistic panel which is reusable through one or more body armor reconditioning cycles.

Another objective of the invention has been to provide a ballistic panel which can be reused in a remanufactured or refurbished vest, while offering the same threat level performance as originally anticipated when the vest was new.

Another objective of the invention has been to provide an improved ballistic panel which, in use, can reduce the cost of body armor to a wearer over an extended period.

To these ends, the invention includes a ballistic panel comprising ballistic-resistant components and an outer covering of a synthetic material wherein the edges are not sewn but joined or sealed integrally by any suitable process. One such process is sonic welding. This produces a strong, flexible, moisture impervious, fused seam. Preferably, the outer cover is moisture-proof, wear and abrasion resistant. The sealing process joins the cover edges in a sealed joint. More particularly, the welding process fuses the material together so there are no sew or thread holes, and no seam structure which can break down and leak.

As a result, the ballistic panel inside the sealed cover is never moisturized; neither water, perspiration or humidity can wet the ballistic components, even if immersed. The performance of the panel does not change. Nor can the panel interior mildew.

When the vest structure needs refurbishment, the manufacturer removes and cleans the intact, impervious panel cover. The vest is refurbished, the cleaned panels inserted and the vest returned with the original panels. New, expensive panels are not required and the vest and its maintenance cost less over the long run. Some additional cost might be added to the vest originally to compensate for periodic maintenance, but resulting in less total cost over its useful service life. Alternately, the vest price can be held low with very inexpensive maintenance charges compared to other vests where maintenance typically requires a costly new ballistic panel.

These and other objectives will become readily apparent from the following written description of a preferred embodiment of the invention and from the drawings in which:

DETAILED DESCRIPTION OF THE PREFERRED EMBODIMENT

Figure 1:
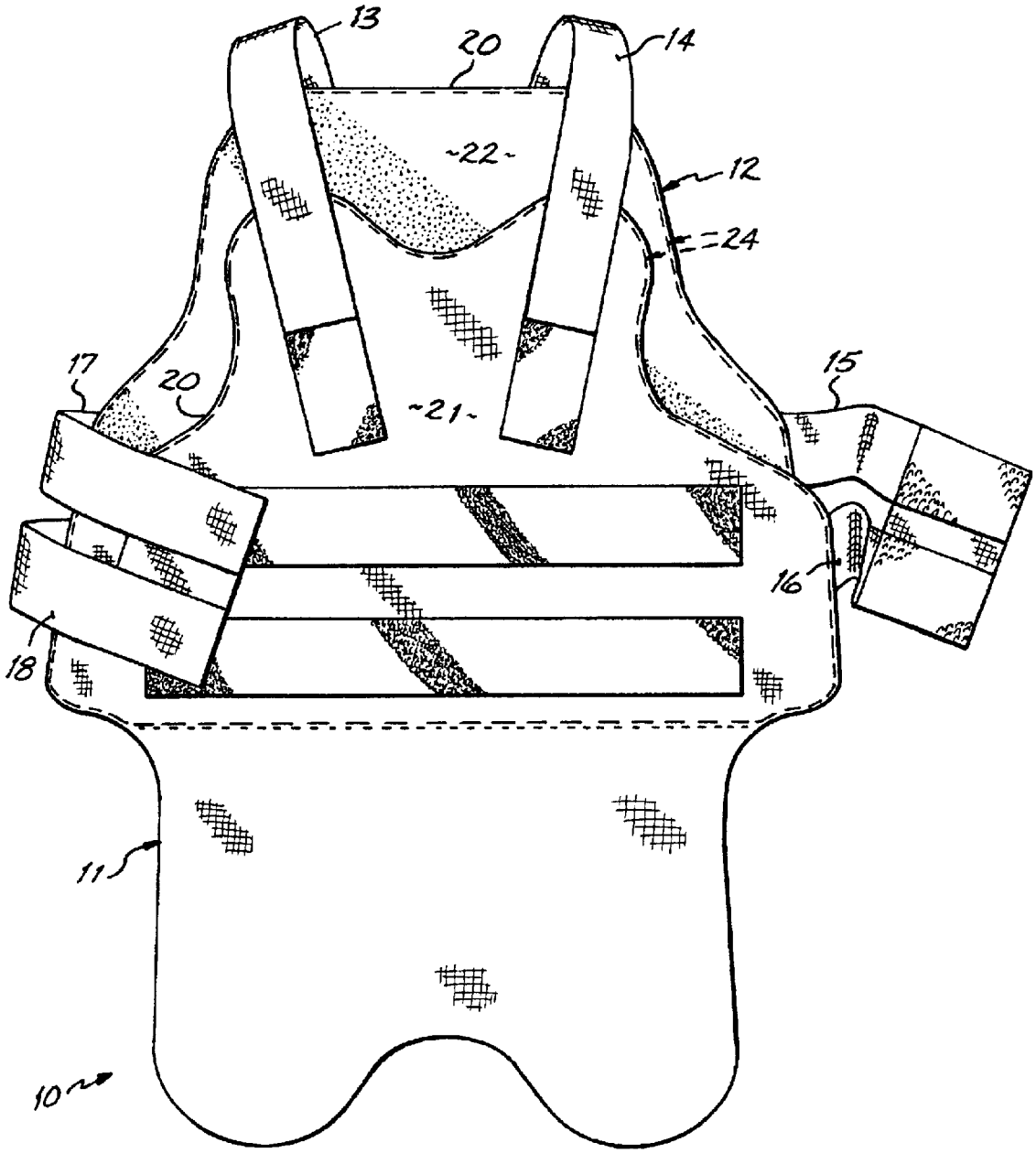
FIG. 1 is a front perspective view of a vest of the type in which ballistic panels according to the invention are inserted in pockets thereof.

Turning now to FIG. 1, there is shown a vest 10 comprising a chest piece 11, a back piece 12, shoulder straps 13, 14 and side straps 15, 16 and 17, 18. Each of the chest and back pieces 11 and 12 are made of any suitable fabric or fabric layers forming a panel-holding pockets 20 therein. The outside layer 21 of each piece may be an abrasion or wear-resistant material of any suitable type and the inner layer 22 may be a moisture-wicking layer or any similarly useful material. A pocket 20 is formed between these layers for holding a ballistic panel 24 therein. The pockets preferably have openings (not shown) permitting panel insertion and removal for cleaning of both vest and panel.

Figure 2:
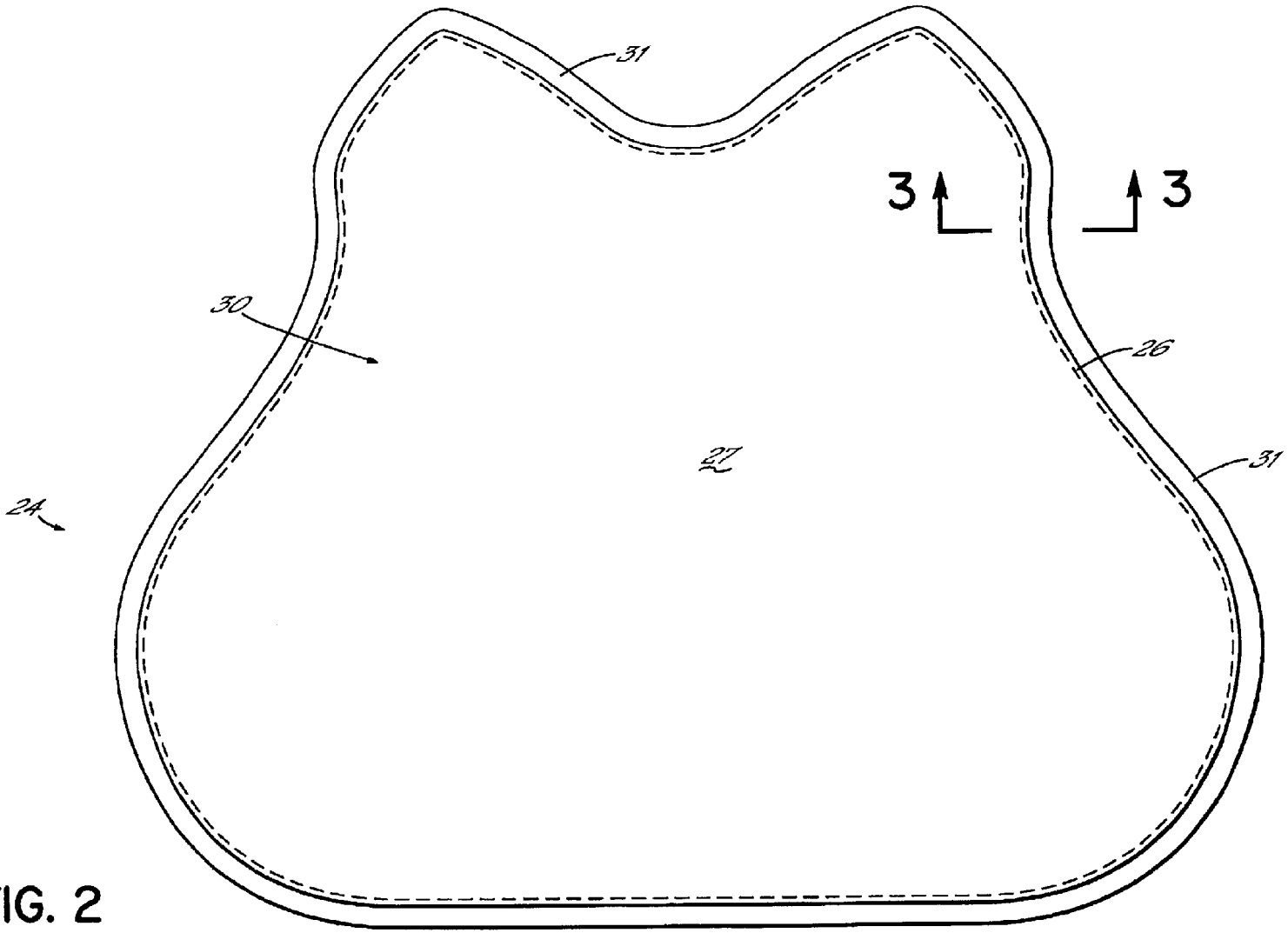
FIG. 2 is an elevational view of a ballistic panel and cover according to the invention.

As shown in FIG. 2, ballistic panel 24 comprises an internal ballistic component 26 of any known construction sealed between moisture impervious layers 27, 28 (FIG. 3) of cover 30. Cover 30 is made from any suitable material. One such suitable material is a single coated taffeta synthetic material comprising 70 denier nylon taffeta at 108×88 threads per inch and weighing about 1.8 ounces per square yard. A coating of flame retardant, polymer polyurethane, at a coating weight of about 2.0 oz. per square yard, is applied. The cover is thus flexible, cleanable, moisture impervious and sealable.

Layers 27, 28 of such cover material are sealed at marginal edge 31, to form a flexible integral joint 32 all around ballistic component 26. The sealing process integrally joins or seals layers 27, 28 together at their respective marginal edges 31 and around component 26. The seal joint 32 at margins 31 can be produced by any suitable device or process. Thus, sealing processes, such as sonic welding, RF welding, heat sealing, chemical or adhesive sealing, or other sealing techniques could be used. For some of these, the cover materials are fused or intermingled mechanically or physically together (such as in sonic welding). In other sealing processes, such as adhesives, the cover materials are simply bound together by the adhesives. In any event, the cover materials are preferably joined together integrally to form a moisture tight chamber for the ballistic panel 24.

Figure 3:
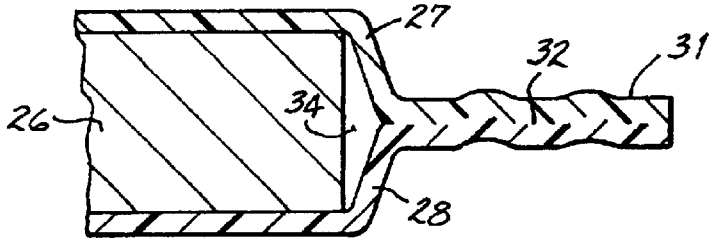
FIG. 3 is a view in cross-section taken along a marginal edge of the panel of FIG. 2 at lines 3—3.

One suitable process is to sonically weld the cover layers 27, 28 so that their respective marginal areas are integrally fused and thus sealed together. As shown in FIG. 3, the sealed joint 32 between layers 27, 28 at margin 31 is integral and no moisture can intrude. One such useful sonic welding device is that sonic welder, model LM920 sold by Sonobond Ultrasonics of West Chester, Pa., USA. In such a sealing process, dimples are generated in the seam material by the sonic welder.

Seals performed by this machine are flexible, but very strong and cannot be pulled apart under normal usage. Their integrity is consistent. The chamber 34 then, formed by seal 32 in layers 27, 28 around component 26, is thus moisture impervious.

As a result, component 26 cannot mildew, and is not open to moisture from any usual source. It will continue to perform ballistically as expected without degradation of its performance which might otherwise be caused by moisture.

Not only does this structure and process deny entry of moisture into the panel so its certified testing and ballistic performance threat level is consistently retained, but its service life is extended through various cleaning and maintenance procedures.

When the vest 10 is worn or needs cleaning, panel 24 is removed from vest 10. Panel cover 30 is cleaned, still without intrusion of moisture into component 26. The vest 10 is refurbished with preferably new carrier and lining materials. The original panel 24 is then reinserted into the refurbished vest 10 and the vest 10 is returned to service. It is not necessary to replace the panel 24, since there is no mildew or moisture intrusion therein. Of course, a vest may use multiple panels such as front, rear or side panels perhaps of different shapes but of similar construction.

Accordingly, the ballistic component 26 of panel 24 remains useful to resist any originally certified threat level while, at the same time, a cleaner, fresher smelling, more consistently performing vest is provided at a low cost over its operational lifetime. Vest refurbishment does not require new ballistic panels.

It should be appreciated that cover 30 can be made of any suitable, moisture impervious material, preferably flexible, and having areas which can be sealed together to provide a moisture impervious, preferably flexible seam or joint. Moisture impervious materials then, may include, without limitation, synthetic materials having such sealing capabilities. Various sealing techniques can be used with such materials to produce such seals. Techniques or materials such as RF welding, hot air sealing, heat tape, vinyl weldings and glues, adhesives or other forms of mechanical, energy or chemical techniques, suitable to seal the cover layer together to form a moisture impervious chamber for ballistic panel 24 are included.

It will thus be appreciated then that the invention contemplates soft body armor, such as a ballistic vest, having one or more pockets for receiving and carrying one or more ballistic panels wherein the panels are encased in a moisture impervious cover with moisture impervious seams, isolating the ballistic components from moisture sources, preventing performance degradation by moisture intrusion, preventing mildew and facilitating vest refurbishment.

What is claimed is:

1. A ballistic panel comprising:

a ballistic-resistant component;

a cover of moisture impervious synthetic material;

said component being surrounded by said cover;

said cover having marginal edges joined together to form an integral sealed, moisture impervious chamber containing said ballistic-resistant component.

2. A panel as in claim 1 wherein said edges are joined together by sonic welding.

3. A panel as in claim 2 wherein said edges are fused together along adjacent faces thereof during said welding and form an integral joint therebetween.

4. A method of making a ballistic panel for a vest comprising the steps of:

depositing a ballistic-resistant component between opposed layers of moisture impervious synthetic material having marginal edges extending beyond said component, joining said edges integrally together to form a moisture impervious sealed joint between said marginal edges and a moisture impervious chamber, between said layers, containing said component.

5. A method as in claim 4 wherein the joining step includes sonically welding the edges together.

6. A method of refurbishing a bullet-resistant vest having a ballistic panel and a vest for carrying said panel, wherein said panel comprises a ballistic component and a moisture impervious synthetic cover sealed integrally therearound and forming a moisture impervious chamber containing said ballistic component, said method comprising:

removing said panel from said vest;

refurbishing said vest;

cleaning said cover; and reinserting said same panel in said vest.

7. Soft body armor comprising in combination:

a ballistic panel; and a panel carrier having a pocket for removably receiving and carrying said panel;

said ballistic panel comprising in combination one or more components for resisting a ballistic threat directed onto said armor and a moisture impervious cover surrounding said components and sealed at edges of the cover to prevent moisture intrusion into said panel from sources of moisture, both when said panel is in said pocket and when said panel is removed therefrom.

8. A ballistic panel comprising:

a ballistic-resistant component;

a cover of moisture impervious synthetic material;

said component being surrounded by said cover;

said cover having marginal edges joined together to form an integral sealed, moisture impervious chamber containing said ballistic-resistant component, wherein said cover of moisture impervious synthetic material comprises single coated taffeta synthetic material comprising 70 denier taffeta at 108×88 threads per inch and weighing about 1.8 ounces per yard, said taffeta having a coating of polymer at a coating weight of about 2.0 ounces per square yard.

9. A ballistic panel as in claim 8 wherein said polymer is polyurethane.

10. A ballistic panel as in claim 9 wherein said marginal edges are joined by sonic welding.

* * * * *